US008102353B2

(12) United States Patent
Matsumoto et al.

(10) Patent No.: US 8,102,353 B2
(45) Date of Patent: Jan. 24, 2012

(54) DISPLAY DEVICE

(75) Inventors: Katsumi Matsumoto, Mobara (JP); Kozo Yasuda, Mobara (JP); Hiroshi Kageyama, Hachioji (JP)

(73) Assignee: Hitachi Displays, Ltd., Chiba-ken (JP)

( * ) Notice: Subject to any disclaimer, the term of this patent is extended or adjusted under 35 U.S.C. 154(b) by 989 days.

(21) Appl. No.: 11/902,740

(22) Filed: Sep. 25, 2007

(65) Prior Publication Data

US 2008/0186291 A1 Aug. 7, 2008

(30) Foreign Application Priority Data

Oct. 3, 2006 (JP) ..... 2006-271674

(51) Int. Cl.
*G09G 3/36* (2006.01)

(52) U.S. Cl. ..... 345/98

(58) Field of Classification Search ..... 345/98–100
See application file for complete search history.

(56) References Cited

U.S. PATENT DOCUMENTS

| | | | | |
|---|---|---|---|---|
| 6,157,228 | A * | 12/2000 | Yokoyama et al. | 345/213 |
| 2004/0222981 | A1 * | 11/2004 | Kobayashi et al. | 345/204 |
| 2004/0239610 | A1 | 12/2004 | Ishii | |

FOREIGN PATENT DOCUMENTS

| | | |
|---|---|---|
| JP | 2003-344824 | 5/2002 |
| JP | 2004-361919 | 12/2004 |
| JP | 2006-227468 | 8/2006 |

OTHER PUBLICATIONS

Notice of Reasons for Rejection Office Action issued by the Japanese Patent Office on Jul. 19, 2011 for the corresponding Japanese Patent Application No. 2006-271674 (4 pages).

* cited by examiner

*Primary Examiner* — Amr Awad
*Assistant Examiner* — Waseem Moorad
(74) *Attorney, Agent, or Firm* — Stites & Harbison PLLC; Juan Carlos A. Marquex, Esq.

(57) ABSTRACT

The present invention is to prevent a capture error of display data caused by a delay due to a built-in driving circuit in a display device with a built-in driving circuit. The display device comprises: a display area having a plurality of sub pixels; and a driving circuit formed at the periphery of the display area; wherein the driving circuit includes: a first scanning circuit that performs scanning in a first direction; and a latch circuit which latches display data inputted from external based on a scanning output outputted from the first scanning circuit; wherein the driving circuit includes a timing correction circuit which corrects the timing of level change of the scanning output outputted from the first scanning circuit based on a display data synchronization clock inputted from external; wherein the latch circuit latches display data by means of a corrected scanning output outputted from the timing correction circuit; and wherein a transmission line up to the latch circuit of the display data and a transmission line up to the timing correction circuit of the display data synchronization clock are adjacently arranged.

8 Claims, 4 Drawing Sheets

PRIOR ART

DISPLAY DEVICE

CLAIM OF PRIORITY

The present application claims priority from Japanese Application JP 2006-271674 filed on Oct. 3, 2006, the content of which is hereby incorporated by reference into this application.

BACKGROUND OF THE INVENTION

1. Field of the Invention

The present invention relates to a display device, and more particularly to a display device with a built-in driving circuit.

2. Description of the Related Art

Since a TFT (thin-film transistor) type liquid crystal display module using a thin-film transistor as an active element is capable of displaying high-resolution images, it is used as a display device for television sets, personal computers, or the like.

As the TFT type liquid crystal display module, a liquid crystal display module with a built-in driving circuit without the need for an external driver (LSI) is known (refer to JP-A-2003-344824).

With a liquid crystal display module with a built-in driving circuit, a driving circuit (for example, a drain driver or a gate driver) is integrally formed with and at the periphery of a display area on one substrate on which a pixel transistor (TFT) for each sub pixel in the display area is formed.

With the liquid crystal display module with a built-in driving circuit, amorphous silicon or poly-silicon is used as a semiconductor layer for a thin-film transistor (TFT) in the built-in driving circuit. A thin-film transistor having a semiconductor layer of poly-silicon has higher mobility than a thin-film transistor having a semiconductor layer of amorphous silicon.

FIG. 4 is a block diagram showing an example of a built-in driving circuit in a conventional liquid crystal display device with a built-in driving circuit.

With the driving circuit shown in FIG. 4, display data (D0) serially inputted as digital data is first changed to a high-voltage amplitude by a level shift circuit (LS), passes through a transmission line (LIN) and an inverter series (LINV) for improving the internal drive performance, and then is inputted to a latch circuit (LACH).

On the other hand, a display data synchronization clock (DCK) and a horizontal synchronization signal (Hsync) are also changed to a high-voltage amplitude by the level shift circuit (LS) and then inputted to a driving pulse generation circuit (POC). The driving pulse generation circuit (POC) outputs a driving pulse for driving a shift register based on the display data synchronization clock (DCK) and the horizontal synchronization signal (Hsync).

The shift register (SR) sequentially supplies a scanning signal (SR-OUT) to a plurality of latch circuits (LACH).

Each latch circuit (LACH) captures (or latches) the display data (D0) serially inputted based on the scanning signal (SR-OUT) and then supplies the data to an internal processing circuit (a D/A converter circuit or a pixel array) (ICIR).

Also for the scanning signal (SR-OUT) generated from the display data synchronization clock (DCK) and the horizontal synchronization signal (Hsync), inverters are inserted at necessary positions in order to improve the internal drive performance. However, these inverters are omitted in FIG. 4.

A conventional technique related to the present specification is disclosed in JP-A-2003-344824.

SUMMARY OF THE INVENTION

However, a thin-film transistor having a semiconductor layer of amorphous silicon or poly-silicon provides lower mobility and wider variations in transistor characteristics, typically a threshold value voltage (Vth)), than a transistor having a semiconductor layer of monocrystal silicon.

On the other hand, in the driving circuit shown in FIG. 4, the timing of the display data (D0) inputted to the latch circuit (LACH) should essentially agree with the timing of the scanning signal (SR-OUT) outputted from the shift register (SR). However, a timing shift is caused by a delay due to the built-in driving circuit, possibly resulting in a capture error of display data (D0).

A main cause of the delay will be explained below. Since the display data (D0) inputted to the latch circuit (LACH) and the scanning signal (SR-OUT) outputted from the shift register (SR) are provided through different wiring configurations, resulting in different load capacitances of internal wiring, etc. Accordingly, a considerable delay of wiring charge and discharge occurs in a thin-film transistor in the built-in driving circuit. Therefore, even by inserting inverters to shorten the delay, a final inverter delay cannot be equalized between the display data and the scanning signal having different wiring configurations in such a way that variations specific to thin-film transistors in the driving circuit built in the liquid crystal display panel are included.

The present invention has been devised to solve the above-mentioned problems of the conventional technique. An object of the present invention is to provide a technique that makes it possible to prevent a capture error of display data caused by a delay due to a built-in driving circuit in a display device with a built-in driving circuit.

The above-mentioned and other objects and new features of the present invention will become apparent from the detailed description of the present specification and the accompanying drawings.

An overview of typical pieces of invention disclosed in the present specification will briefly be explained below.

(1) A display device comprising: a display area having a plurality of sub pixels; and a driving circuit formed at the periphery of the display area; wherein the driving circuit includes a first scanning circuit that performs scanning in a first direction, and a latch circuit which latches display data inputted from external based on a scanning output outputted from the first scanning circuit; wherein the driving circuit includes a timing correction circuit which corrects the timing of level change of a scanning output outputted from the first scanning circuit based on a display data synchronization clock inputted from external; wherein the latch circuit latches display data by means of a corrected scanning output outputted from the timing correction circuit, and wherein a transmission line up to the latch circuit of the display data and a transmission line up to the timing correction circuit of the display data synchronization clock are adjacently arranged.

(2) The display device according to (1), wherein the same number of a plurality of inverter circuits are inserted in both the transmission line up to the latch circuit of the display data and the transmission line up to the timing correction circuit of the display data synchronization clock.

(3) The display device according to (1) or (2), wherein the driving circuit includes a first driving pulse generation circuit which outputs a driving pulse for the first scanning circuit based on the horizontal synchronization signal and the display data synchronization clock inputted from external.

(4) The display device according to any one of (1) to (3), wherein the driving circuit is integrally formed with the display area by use of thin-film transistors on a substrate on which the display area is formed.

(5) The display device according to (4), wherein each of the thin-film transistors includes a semiconductor layer of poly-silicon.

(6) The display device according to any one of (1) to (5), wherein the timing correction circuit is composed of: a first clocked inverter which inputs a scanning output outputted from the first scanning circuit, the display data synchronization clock being applied to a clock terminal; and a second clocked inverter which inputs an output of the first clocked inverter, an inverted clock of the display data synchronization clock being applied to a clock terminal.

Effects obtained by typical pieces of invention disclosed in the present specification will briefly be explained below.

In accordance with the present invention, it becomes possible to prevent a capture error of display data caused by a delay due to a built-in driving circuit in a display device with a built-in driving circuit.

DETAILED DESCRIPTION OF THE PREFERRED EMBODIMENTS

An embodiment of the present invention which is applied to a liquid crystal display device will be explained in detail below with reference to the accompanying drawings.

In all drawings used to explain the embodiment, elements having the same function are assigned the same symbol and duplicated explanations are omitted.

Figure 1:
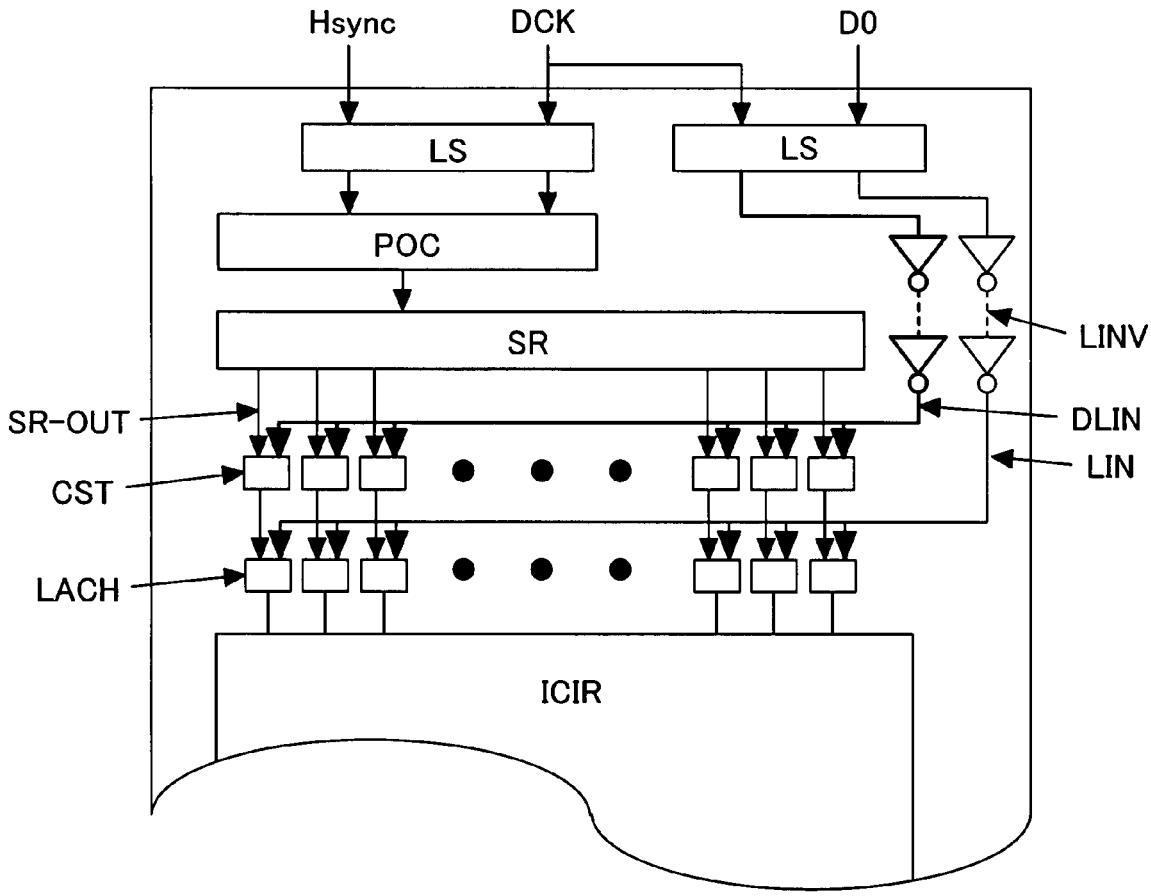
FIG. 1 is a block diagram showing an example of a built-in driving circuit in a liquid crystal display module according to an embodiment of the present invention.

FIG. 1 is a block diagram showing an example of a built-in driving circuit in a liquid crystal display module according to an embodiment of the present invention.

With the liquid crystal display module according to the present embodiment, a case when a thin-film transistor having a semiconductor layer of poly-silicon is used for the built-in driving circuit will be explained.

The driving circuit shown in FIG. 1 includes a timing correction circuit (CST) between a shift register (SR) and a latch circuit (LACH), which corrects the timing of level change of a scanning signal (SR-OUT) outputted from the shift register (SR) based on a display data synchronization clock (DCK). A transmission line (LIN) of display data (D0) inputted to the latch circuit (LACH) and a transmission line (DLIN) of a display data synchronization clock (DCK) inputted to the timing correction circuit (CST) are adjacently arranged with the same wiring configuration.

The transmission line (DLIN) of the display data synchronization clock (DCK) is arranged adjacently with the transmission line (LIN) of the display data (D0) through completely the same wiring configuration (the same level shift circuit (LS), the same wiring, and the same total number of inverters). Therefore, the amount of delay of the inputted display data synchronization signal (DCK) equals that of the display data (D0).

Therefore, in accordance with the present embodiment, timing correction of the scanning signal (SR-OUT) outputted from the shift register (SR) is once performed based on the display data synchronization clock (DCK) from the transmission line (DLIN) in the timing correction circuit (CST). This means, in accordance with the present embodiment, that the timing of the display data (D0) actually inputted to the latch circuit (LACH) always agrees with the timing of the scanning signal.

Also with the liquid crystal display module according to the present embodiment, a liquid crystal display panel is formed by laminating a glass substrate (hereafter referred to as TFT substrate) with pixel transistors, image lines, scanning lines, etc. formed thereon and a glass substrate (hereafter referred to as CF substrate) with opposing electrodes, color filters, etc. formed thereon, using seal agent, and then encapsulating liquid crystal between the TFT substrate and the CF substrate.

Figure 2:
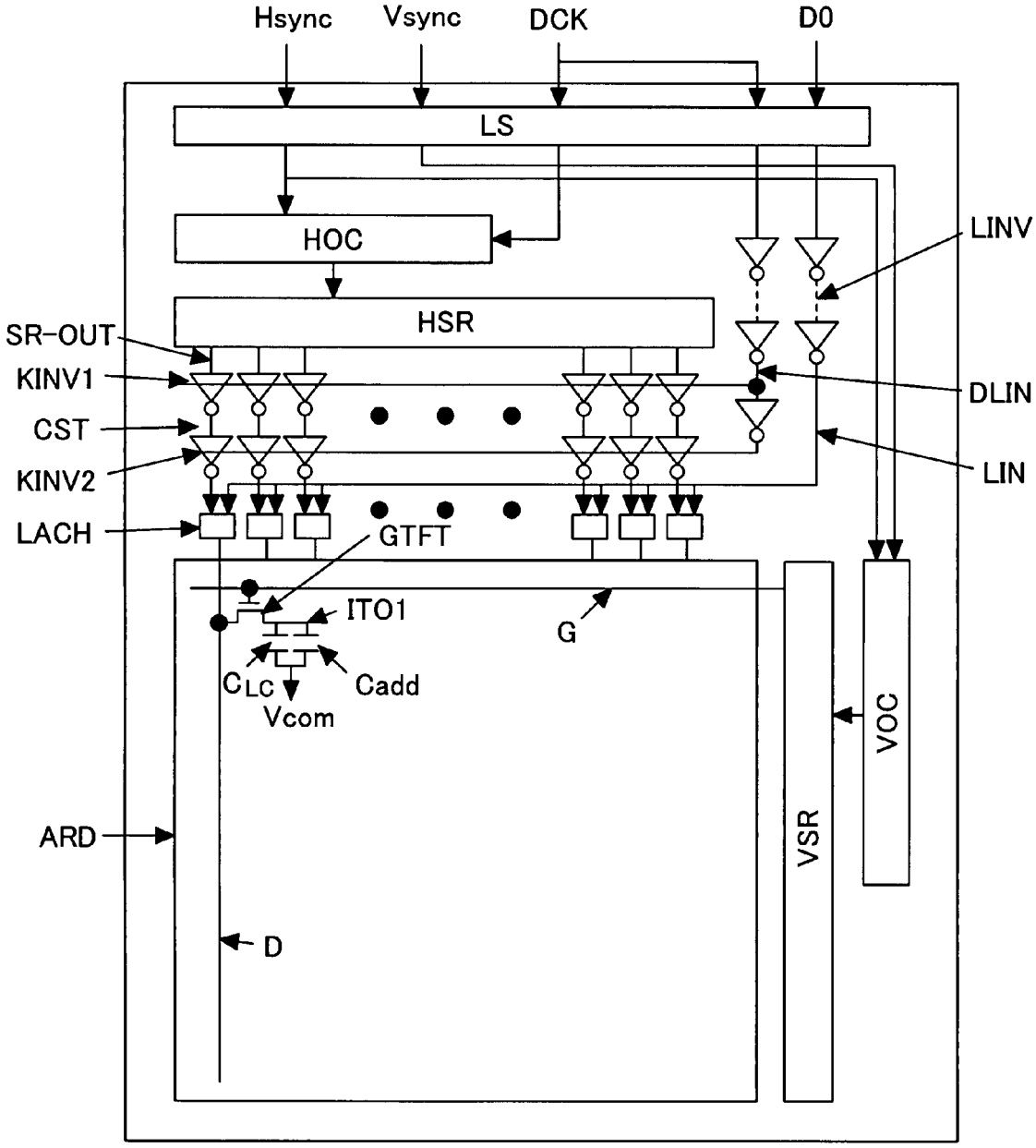
FIG. 2 is a block diagram showing a schematic configuration of a TFT substrate of a liquid crystal display module according to an embodiment of the present invention.

FIG. 2 is a block diagram showing a schematic configuration of a TFT substrate of the liquid crystal display module according to an embodiment of the present invention. The liquid crystal display module includes a driving circuit composed of thin-film transistors having a semiconductor layer of poly-silicon, on a TFT substrate of a liquid crystal display panel for cellular phones.

The display data (D0), the display data synchronization signal (DCK), the horizontal synchronization signal (Hsync), and the vertical synchronization signal (Vsync) are inputted from external of the liquid crystal display module.

Referring to FIG. 2, the display data (D0) serially inputted is changed to a high-voltage amplitude by the level shift circuit (LS), passes through the inverter series (LINV) for improving the internal drive performance, and are inputted to the latch circuit (LACH).

On the other hand, the display data synchronization clock (DCK) is also changed to a high-voltage amplitude by the level shift circuit (LS) and then inputted to the horizontal scanning driving pulse generation circuit (HOC). Further, the horizontal synchronization signal (Hsync) is also changed to a high-voltage amplitude by the level shift circuit (LS) and then inputted to the horizontal scanning driving pulse generation circuit (HOC) and the vertical scanning driving pulse generation circuit (VOC).

The horizontal scanning driving pulse generation circuit (HOC) outputs a driving pulse for driving a horizontal scanning shift register based on the display data synchronization clock (DCK) and the horizontal synchronization signal (Hsync).

The horizontal scanning shift register (HSR) sequentially supplies the scanning signal (SR-OUT) to a plurality of latch circuits (LACH).

On the other hand, the vertical synchronization signal (Vsync) is also changed to a high-voltage amplitude by the level shift circuit (LS) and then inputted to the vertical scanning driving pulse generation circuit (VOC).

The vertical scanning driving pulse generation circuit (VOC) outputs a driving pulse for driving a vertical scanning shift register based on the horizontal synchronization signal (Hsync) and the vertical synchronization signal (Vsync).

The vertical scanning shift register (VSR) sequentially selects scanning lines (G).

Each latch circuit (LACH) captures (or latch) display data (D0) serially inputted based on the scanning signal (SR-OUT) and then supplies the data to image lines (D).

The display area (ARD) includes a plurality of sub pixels arranged in matrix form and image lines (also referred to as source lines or drain lines) (D) used to supply an image voltage to each sub pixel, and scanning lines (also referred to as gate lines) (G) used to supply a scanning voltage to each sub pixel.

Each sub pixel includes a pixel transistor (GTFT) which is connected between an image line (D) and a pixel electrode (ITO1) with a gate connected to a scanning line (G).

Since liquid crystal is encapsulated between the pixel electrode (ITO1) and a common electrode (not shown), a liquid crystal capacitance (CLC) is equivalently connected therebetween. Further, a retention capacitance (Cadd) is also connected between the pixel electrode (ITO1) and the common electrode.

When the gate line (G) is selected by the vertical scanning shift register (VSR), the pixel transistor (GTFT) whose gate is connected to the selected gate line (G) turns on; and the display data on the image line (D) is applied to the pixel electrode (ITO1) through the pixel transistor (GTFT) to be written to the liquid crystal capacitance (CLC) and the retention capacitance (Cadd).

In an example shown in FIG. 2, since a voltage applied to a pixel electrode (ITO1) is H and L levels of the display data, a total of eight grayscales ($=2^3$) are provided. If more than eight grayscales are required, an area1 grayscale method is preferably used.

Alternatively, it is preferable to generate a grayscale voltage with multiple grayscale levels by means of a D/A converter circuit based on the display data latched by each latch circuit (LACH) and apply the grayscale voltage to the pixel electrode (ITO1). Further, Vcom is an opposing voltage applied to an opposing electrode.

In the example shown in FIG. 2, the timing correction circuit (CST) is composed of a first clocked inverter (KINV1) and a second clocked inverter (KINV2). The display data synchronization clock (DCK) from the transmission line (DLIN) is applied to a clock terminal of the first clocked inverter (KINV1), and an inverted clock (barred DCK) of the display data synchronization clock (DCK) from the transmission line (DLIN) is applied to a clock terminal of the second clocked inverter (KINV2).

Assume that the display data synchronization clock (DCK) is a waveform shown in FIG. 3A, the inverted clock (barred DCK) of the display data synchronization clock (DCK) is a waveform shown in FIG. 3B, and the scanning signal (SR-OUT) outputted from the horizontal scanning shift register is a waveform shown in FIG. 3C. An output (barred Sampling Pulse) of the first clocked inverter (KINV1) is a waveform shown in FIG. 3D, and an output (Sampling Pulse) of the second clocked inverter (KINV1) is a waveform shown in FIG. 3E.

Figure 3:
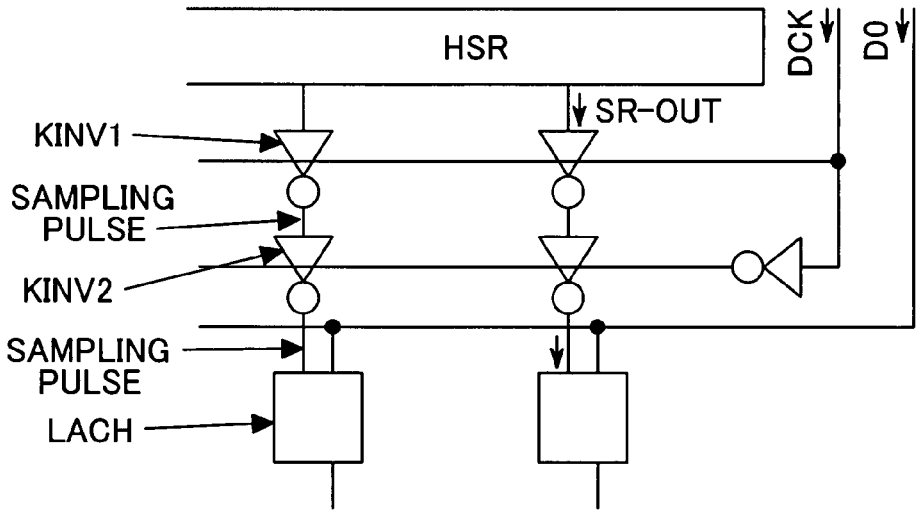
FIG. 3 is a diagram for explaining operations of a first clocked inverter (KINV1) and a second clocked inverter (KINV2) shown in FIG. 2.
Figure 3:
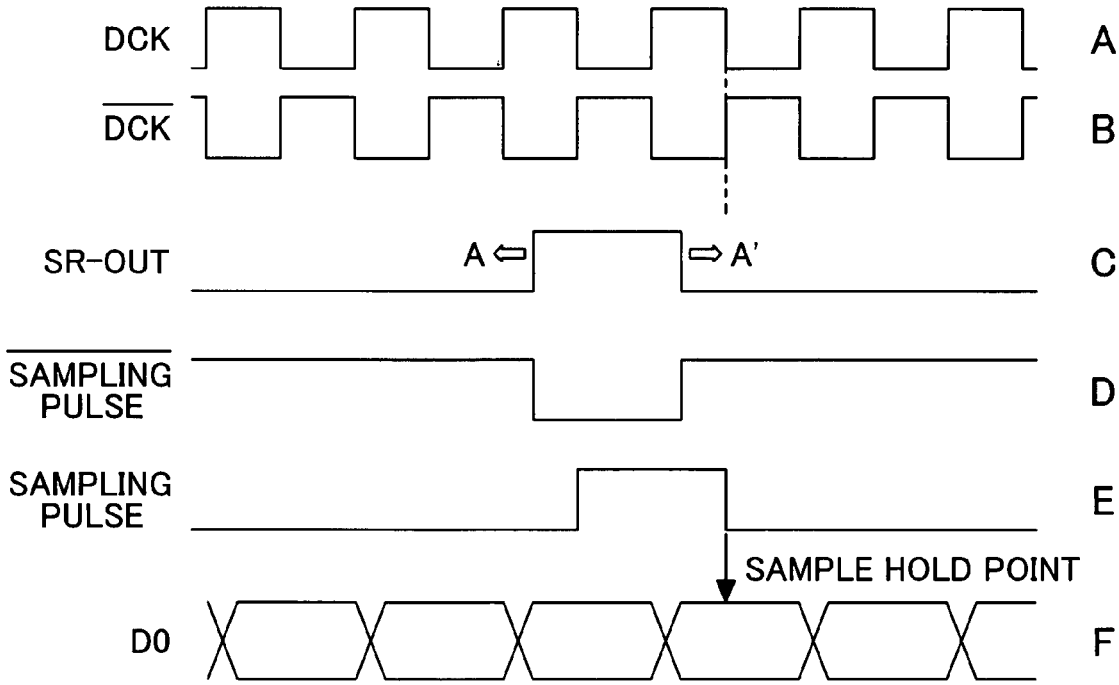
Figure 4:
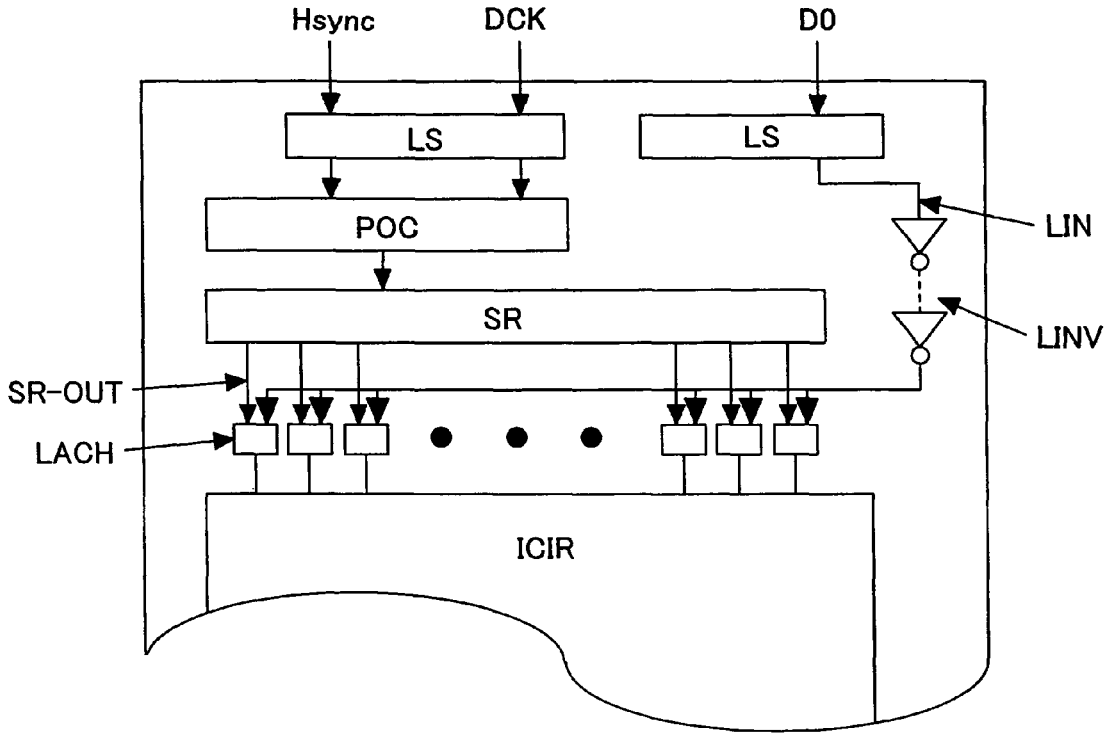
FIG. 4 is a block diagram showing an example of a built-in driving circuit in a conventional liquid crystal display device with a built-in driving circuit.

Because of a delay caused by the built-in driving circuit, rising and falling time points of the scanning signal (SR-OUT) outputted from the horizontal scanning shift register may fluctuate as shown by arrows (A and A') of FIG. 3.

However, in the example shown in FIG. 2, even if rising and falling time points of the scanning signal (SR-OUT) outputted from the horizontal scanning shift register fluctuate, rising and falling time points of a corrected scanning signal (Sampling Pulse) inputted to the latch circuit (LACH) are in synchronization with rising and falling time points of the display data synchronization clock (DCK).

In accordance with the present embodiment, since the transmission line (DLIN) of the display data synchronization clock (DCK) is arranged adjacently with the transmission line (LIN) of the display data (D0) through completely the same wiring configuration (the same level shift circuit (LS), the same wiring, and the same total number of inverters), the amount of delay of the inputted display data synchronization signal (DCK) equals the amount of delay of the display data (D0). Therefore, as shown in FIG. 3F, it becomes possible to adjust a sample hold point of the display data in the latch circuit (LACH) to an optimum position.

Although a case when thin-film transistors having a semiconductor layer of poly-silicon are used for the built-in driving circuit has been explained above, the present invention is not limited to the above-mentioned embodiment. It is also possible to use a thin-film transistor having a semiconductor layer of amorphous silicon.

Further, the present invention is not limited to a liquid crystal display device, but is applicable, for example, to an organic EL display device and other pixel-based display devices.

Although the invention devised by the present inventor has been described in details based on the above-mentioned embodiment, the present invention is not limited thereto but may be modified in diverse ways without departing from the essential characteristics thereof.

What is claimed is:

1. A display device comprising:

a display area having a plurality of sub pixels; and a driving circuit formed at the periphery of the display area;

wherein the driving circuit includes:

a first scanning circuit which performs scanning in a first direction; and a latch circuit which latches display data inputted from external based on a scanning output outputted from the first scanning circuit;

wherein the driving circuit includes a timing correction circuit which corrects a timing of level change of the scanning output outputted from the first scanning circuit based on a display data synchronization clock inputted from external;

wherein a first transmission line extends to the latch circuit and applies the display data, a second transmission line extends to the timing correction circuit and applies the display data synchronization clock, and a third transmission line different from the second transmission line extends to the timing correction circuit and applies the scanning output;

wherein the latch circuit latches display data by means of a corrected scanning output outputted from the timing correction circuit;

wherein the second transmission line is not connected with the first scanning circuit;

wherein the first transmission line and the second transmission line are adjacently arranged, and wherein at least a same quantity of inverter circuits are inserted in the second transmission line as the first transmission line.

2. The display device according to the claim 1, wherein:

the driving circuit includes a first driving pulse generation circuit which outputs a driving pulse for the first scanning circuit based on a horizontal synchronization signal and the display data synchronization clock inputted from external.

3. The display device according to the claim 1, wherein:

the driving circuit is integrally formed with the display area by use of thin-film transistors on a substrate on which the display area is formed.

4. The display device according to the claim 3, wherein:

each of the thin-film transistors includes a semiconductor layer of poly-silicon.

5. The display device according to the claim 1, wherein:

the timing correction circuit is composed of:

a first clocked inverter which inputs the scanning output outputted from the first scanning circuit, the display data synchronization clock being applied to a clock terminal of the first clocked inverter; and a second clocked inverter which inputs an output of the first clocked inverter, an inverted clock of the display data synchronization clock being applied to a clock terminal of the second clocked inverter.

6. The display device according to the claim 2, wherein:

the driving circuit includes a second scanning circuit which performs scanning in a second direction different from the first direction.

7. The display device according to the claim 6, comprising:

a second driving pulse generation circuit which outputs a driving pulse for the second scanning circuit based on the horizontal synchronization signal and a vertical synchronization signal inputted from external.

8. The display device according to claim 1, wherein:

the driving circuit includes a level shift circuit, the display data is input to the latch circuit via the level shift circuit and the first transmission line, and the display data synchronization clock is input to the timing correction circuit via the level shift circuit and the second transmission line.

* * * * *

UNITED STATES PATENT AND TRADEMARK OFFICE

CERTIFICATE OF CORRECTION

PATENT NO. : 8,102,353 B2
APPLICATION NO. : 11/902740
DATED : January 24, 2012
INVENTOR(S) : Matsumoto et al.

It is certified that error appears in the above-identified patent and that said Letters Patent is hereby corrected as shown below:

On the Title Page, under Item (73) please amend the Assignee by adding as the second assignee "Panasonic Liquid Crystal Display Co., Ltd., Hyogo-Ken, Japan"

Signed and Sealed this
Fourteenth Day of August, 2012

David J. Kappos

David J. Kappos
*Director of the United States Patent and Trademark Office*